United States Patent [19]

Haupt

[11] Patent Number: 4,689,635

[45] Date of Patent: Aug. 25, 1987

[54] APPARATUS FOR ORIENTATING TV ANTENNAS FOR SATELLITE RECEPTION

[75] Inventor: Gene Haupt, Granada Hills, Calif.

[73] Assignee: Allegretti & Company, Chatsworth, Calif.

[21] Appl. No.: 638,211

[22] Filed: Aug. 6, 1984

[51] Int. Cl.[4] ..... H01Q 3/00

[52] U.S. Cl. ..... 343/894

[58] Field of Search ..... 343/760, 894, 840, 882

[56] References Cited

U.S. PATENT DOCUMENTS

| | | | |
|---|---|---|---|
| 4,003,055 | 1/1977 | Eriksson et al. | 343/760 |
| 4,126,865 | 11/1978 | Longhurst et al. | 343/766 |
| 4,237,465 | 12/1980 | Shibano | 343/894 |
| 4,475,110 | 10/1984 | Hutchins | 343/882 |
| 4,495,706 | 1/1985 | Kaminski | 343/894 |

OTHER PUBLICATIONS

Easton; The Satellite TV Handbook; Howard W. Sams & Co, 1983, pp. 185, 188.

*Primary Examiner*—Eli Lieberman
*Attorney, Agent, or Firm*—Lyon & Lyon

[57] ABSTRACT

This invention relates to an improved means of orienting parabolic dish shaped TV antennas for receiving signals from relay satellites orbiting the earth, an angle indicating means associated with antenna assembly which indicates either the angle of elevation or the complementary angle then of which is equivalent to the latitude of the antenna site plus the offset or declination angle.

1 Claim, 6 Drawing Figures

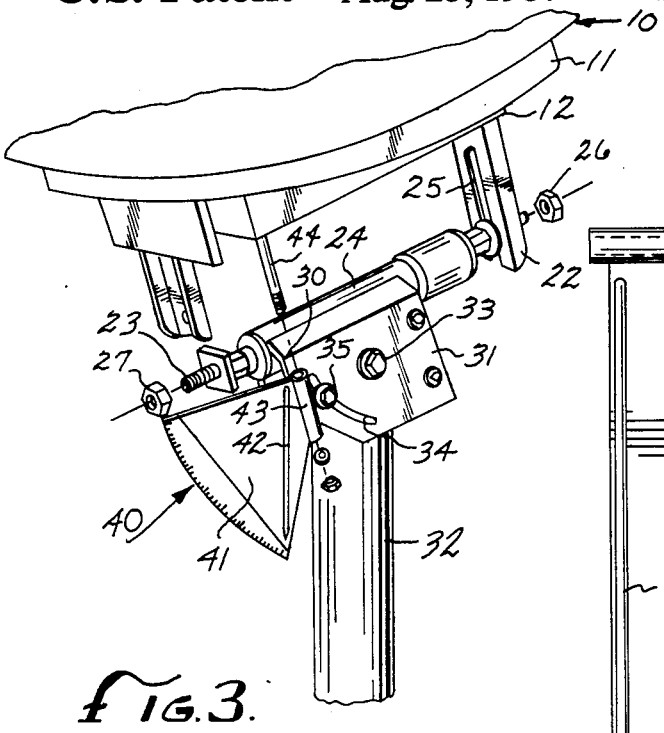
FIG. 3.
FIG. 4.
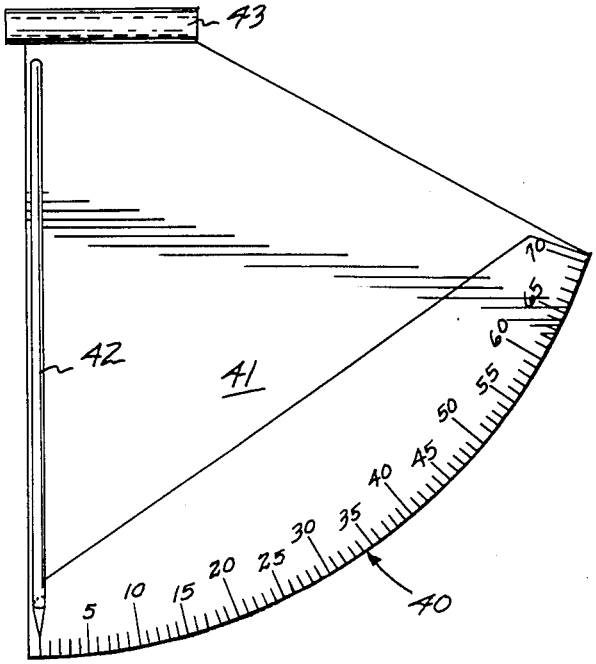
FIG. 5.
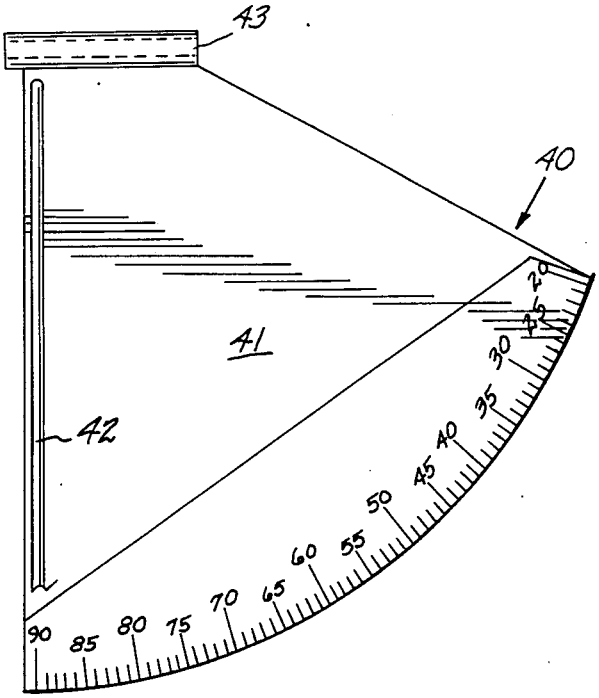
FIG. 6.
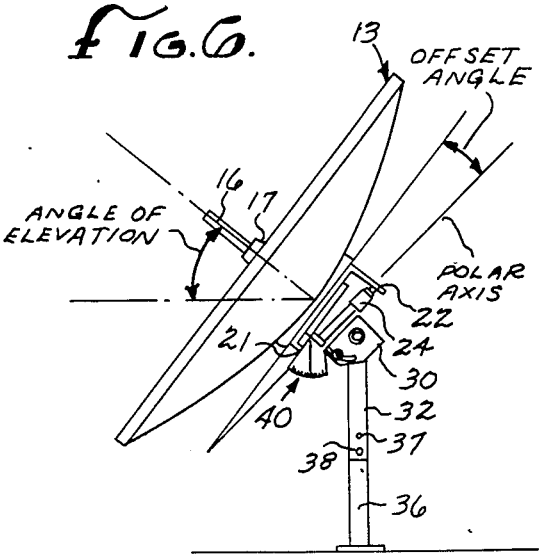

APPARATUS FOR ORIENTATING TV ANTENNAS FOR SATELLITE RECEPTION

BACKGROUND OF THE INVENTION

This invention generally relates to parabolic, dish-shaped antennas for receiving television and other communication signals from relay satellites which are in orbit around the earth.

For domestic television, telephone and other communication uses, the U.S. Government and other organizations have placed a series of relay satellites in a circular geosynchronous orbit about the equator of the earth at a distance of about 22,300 miles as shown schematically in FIG. 1. These satellites receive signals from one place in the United States and relay the signals back to earth so that receptors or antennas at other positions in the United States can pick up the relayed signals. To receive a usable signal from the satellites, the receiver or antenna should be oriented within about 1° of the satellite.

If the signal receptor or antenna is to be located at the equator, the apparent orbit and the actual orbit of the satellites are the same, i.e., circular. However, as the location of the receptor or antenna is moved farther away from the equator the more the apparent orbit of the relay satellites as viewed from the antenna site become oval in shape, which makes the tracking thereof for optimum signal reception very difficult.

To properly receive the signal, the mounting generally used with parabolic dish-shaped antennas is similar in certain respects to the equatorial mount frequently used for telescopes. The base of the parabolic dish is supported on a rotating shaft which is on a polar axis parallel to the earth's axis. In the northern hemisphere the polar axis of the mount is inclined in a true north direction at an angle with the horizontal equivalent to the latitude of the site and the axis of the parabolic dish is pointed generally in the direction of true south with the axis of the dish 90° from the polar axis. To compensate for the change in the shape of the apparent satellite orbit the farther north or south of the equator the antenna site is located, the angle between the support base of the dish antenna and the polar axis must be inclined to the polar axis a gradually increasing amount the farther north or south the antenna site is located. This angle, called the declination or offset angle has been determined for each latitude and it is set forth in the table below.

| ANGLE OF OFFSET OR DECLINATION | | | | | | | |
|---|---|---|---|---|---|---|---|
| Lat. | Offset Angle | Lat. | Offset Angle | Lat. | Offset Angle | Lat. | Offset Angle |
| 1 | .01 | 16 | 2.8 | 31 | 5.1 | 46 | 7.0 |
| 2 | .36 | 17 | 3.0 | 32 | 5.3 | 47 | 7.1 |
| 3 | .54 | 18 | 3.1 | 33 | 5.4 | 48 | 7.2 |
| 4 | .72 | 19 | 3.3 | 34 | 5.5 | 49 | 7.3 |
| 5 | .90 | 20 | 3.5 | 35 | 5.7 | 50 | 7.4 |
| 6 | 1.07 | 21 | 3.6 | 36 | 5.8 | 51 | 7.5 |
| 7 | 1.25 | 22 | 3.8 | 37 | 6.0 | 52 | 7.6 |
| 8 | 1.43 | 23 | 4.0 | 38 | 6.1 | 53 | 7.7 |
| 9 | 1.60 | 24 | 4.1 | 39 | 6.2 | 54 | 7.8 |
| 10 | 1.78 | 25 | 4.3 | 40 | 6.3 | 55 | 6.8 |
| 11 | 1.95 | 26 | 4.4 | 41 | 6.5 | 56 | 7.9 |
| 12 | 2.13 | 27 | 4.6 | 42 | 6.6 | 57 | 8.0 |
| 13 | 2.3 | 28 | 4.7 | 43 | 6.7 | 58 | 8.0 |
| 14 | 2.5 | 29 | 4.8 | 44 | 6.8 | 59 | 8.1 |
| 15 | 2.6 | 30 | 5.0 | 45 | 6.9 | 60 | 8.2 |

This slight modification to the mount allows the position of the antenna dish to be adjusted to receive an optimum signal from one satellite which will then provide optimum reception from essentially all of the satellites within the range of the antenna.

However, these positional requirements make the installation of parabolic dish-shaped antennas by anyone other than highly trained personnel most difficult. The antenna dish can range in size from 6 to 20 feet in diameter which makes the manual control of the unit during the installation and orientation thereof most difficult, particularly with the accuracy required to obtain an optimum signal from the satellites.

Many commercial establishments such as hotels, bars and entertainment centers are installing antennas in order to be able to offer a wider fare of television entertainment to their customers. Moreover, many individuals are also installing these types of antennas for essentially the same reason. However, as more antennas are installed, the need for a more simple method of installation and orientation becomes apparent.

The present invention provides an improved mounting device which greatly simplifies the installation and particularly the orientation of a parabolic dish-shaped antenna.

BRIEF DESCRIPTION OF THE INVENTION

The present invention is directed to an improved system which greatly facilitates the installation and orientation of antennas for receiving signals from satellites orbiting the earth and is particularly directed to antennas having parabolic dish shaped signal receptors mounted on polar axes.

In accordance with the invention, an angle indicating means is fixed to the parabolic dish shaped signal receptor or an underlying support frame associated therewith, both hereinafter identified as receptor assembly, to indicate either the angle between the axis of the parabolic signal receptor and the horizontal, frequently called the angle of elevation, or the compliment of any such angle which is the sum of latitude for the antenna site and the offset angle.

In its simplest form, the angle indicating means comprises a planar element marked with angles and provided with a free-hanging pointer which points downwardly, i.e., perpendicular to the horizontal. When the vertical orientation of the receptor assembly is changed, the free-hanging pointer then indicates a new angle of orientation. The planar element is rotatably mounted to the receptor or the support base so that the axis of rotation thereof is either parallel or perpendicular to the axis of the receptor and thereby always be oriented perpendicular to the horizontal.

If the angle of elevation is indicated on the freely rotating planar element; the pointer will be at the 0° mark when the axis of the parabolic receptor is horizontal, whereas, if the complimentary angle is indicated on the planar element, then the pointer will be at 90° when the axis of the receptor is horizontal.

The entire range from 0° to 90° need not be shown on the angle incidica means because for the most part a range of this magnitude is not needed. However, a range of at least 0°–60° should be indicated when the angle of elevation is utilized and a range of at least 90°–30° should be indicated when the sum of the latitude and the offset or declination angle is utilized to simplify the proper orientation of the receptor assembly.

In this manner, the offset or declination angle between the receptor assembly and the polar axis can be first adjusted to meet the requirements for the latitude of the antenna site. Then the entire receptor assembly is rotated about the supporting polar axis until the angle shown on the angle indicator is equivalent to the prescribed angle of elevation of a particular satellite at the location site of the antenna or the complimentary angle. In general, before any adjustments are made, the polar axis should be pointing in a generally northern direction and the axis or face of the parabolic receptor should be pointing in a generally southern direction. Then the antenna assembly is rotated on a support base in a horizontal plane until the desired optimum signal is received from the particular satellite.

Although only a simple angle indicator means are described herein, it is obvious that other more sophisticated devices can be employed. For example, electronic angle indicators or inclinometers, both analog and digital, can be utilized within the scope and intent of the present invention.

These and other advantages and improvements will become more apparent in the following detailed description when taken in conjunction with the accompanying drawings.

DESCRIPTION OF THE DRAWINGS

FIG. 3 is an elevational view showing the antenna support assembly;

FIGS. 4 and 5 are elevational views of angle indicating units; and

FIG. 6 is an elevational view illustrating the offset or declination angle and the angle of elevation of an antenna.

DETAILED DESCRIPTION OF THE INVENTION

Figure 2:
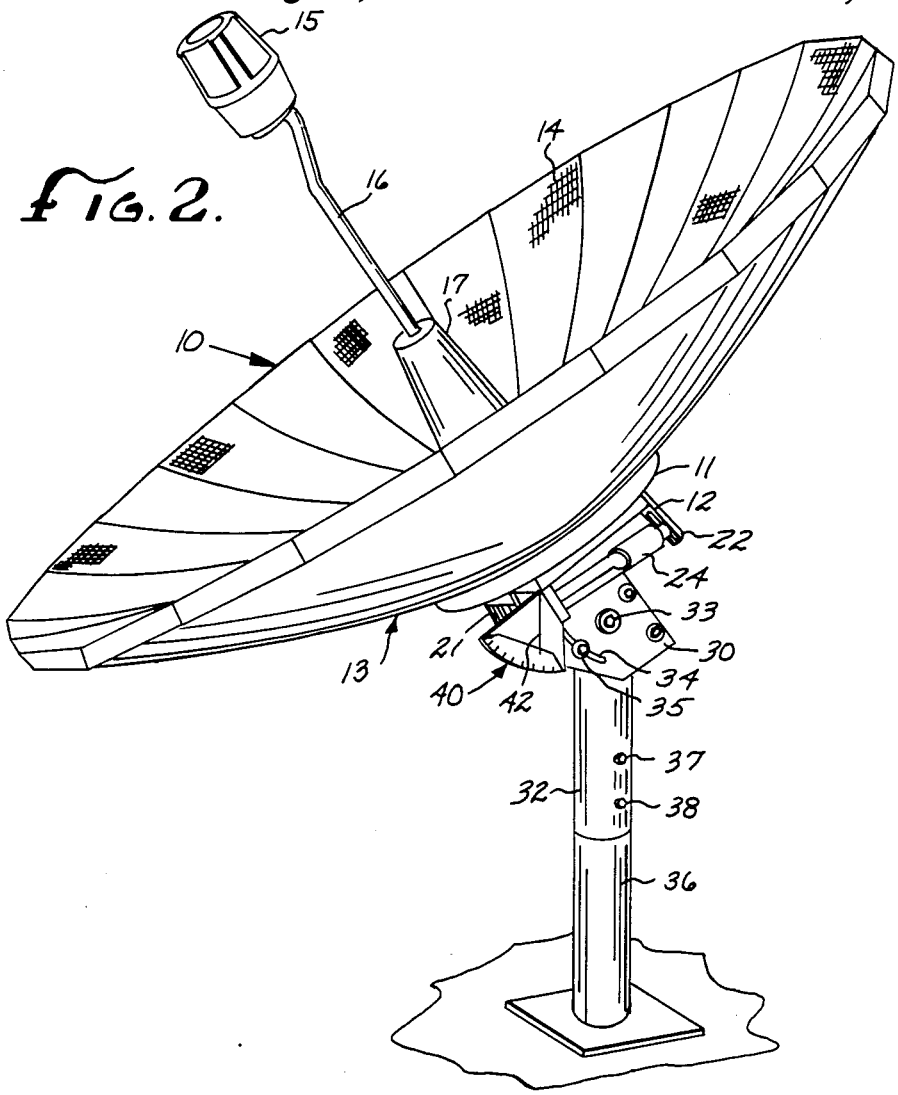
FIG. 2 is a perspective view of an antenna which embodies features of the invention.
Figure 1:
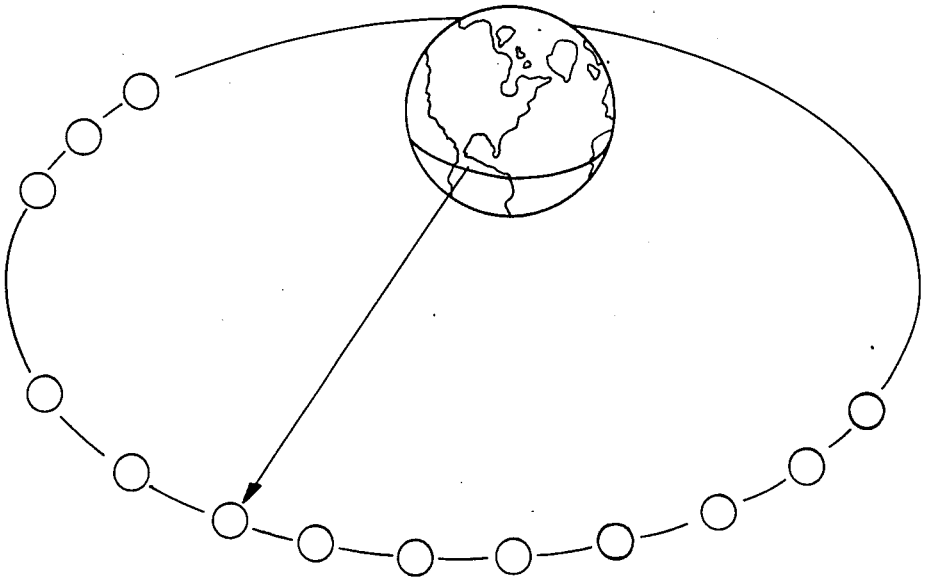
FIG. 1 is a schematic drawing showing the positions of the equatorial satellites in geosynchronous orbits about the earth.

Reference is made to FIGS. 2 and 3 which illustrates an antenna assembly which embodies features of the present invention. Generally, the antenna comprises a parabolic reflector 10 supported by a mounting hub 11 fixed to a frame 12 which forms the basic structure of the receptor assembly 13. Although the term parabolic is used herein to identify the shape of the dish shaped signal reflector, those skilled in the art will recognize that the expression "paraboloid of revolution" would be more correct in describing the shape of the reflector. The inner surface of the reflector is lined with a fine mesh screen 13 which reflects the signals from the satellite to a signal receptor 15 mounted on a support arm 16 which passes through the nose cone 17 and is supported thereby. The receptor 15 is at the focal point of the parabolic shaped reflector.

The parabolic reflector 10 and hub 11 are mounted on a support frame 12 which is provided with two depending brackets 21 and 22 which fit on the ends of the shaft 23 aligned with the polar axis which is journaled in housing 24. As best shown in FIG. 2 and 3, bracket 22 is forked shaped and has an open slot 25 at the end thereof to fit over the shaft 23 and bracket 21 is provided with a circular opening (not shown) through which the shaft 23 projects. Both ends of the shaft 23 are threaded and nuts 26 and 27 are provided to tighten the brackets 21 and 22 onto the shaft 23 so that the receptor assembly 13, comprising the receptors 10, the hub 11 and the frame 12, rotates with the shaft 23 about the polar axis 28.

To set the offset or declination angle between the receptor assembly 13 and the polar axis shaft 23, the nut 26 on the north end of the polar axis shaft 23 is loosened so the angle between the receptor assembly 13 and the polar axis shaft 23 can be adjusted to the desired angle by raising or lowering depending bracket 21 and when the angle is properly adjusted the nut 26 is tightened to ensure that the offset or declination angle is maintained during use of the antenna. Although not shown, hand or motor operated means are usually provided to rotate the receptor assembly 13 about the axis polar axis shaft 23.

As best shown in FIG. 3, the polar axis housing 24 is welded to or otherwise supported by brackets 30 and 31 which are rotatably mounted to the main supporting pipe or cylinder 32 by means of bolt 33. Arcuate slot 34 is provided in bracket 31 and another (not shown) is provided in bracket 30 through which bolt 35 projects. When the bolts 33 and 35 are loosened, the brackets 30 and 31 can be rotated about the axis of bolt 33 and thereby allow the adjustment of the angle (equal to the latitude) between the polar axis shaft 23 and the horizontal.

The main support pipe or cylinder 32 is rotatably mounted on a mounting post 36 which is fixed in a vertical direction in a suitable base such as concrete (not shown). This allows the entire assembly to be rotated into a true north-south direction as required for the proper orientation of the receptor assembly 13 to obtain the optimum strength signals from the equatorial satellites. The main support pipe or cylinder 32 is fixed to the mounting post 36 by the tightening set screws 37 and 38 after the assembly is properly positioned.

FIGS. 4 and 5 illustrate the angle indicia means 40 comprising a planar element 41 a pointer 42 and indicia for respectively the angle of elevation (FIG. 4) and the complementary angle thereof (FIG. 5) which is the sum of the latitude and offset or declination angle. The planar element 41 has a hollow cylindrically shaped mounting member 43 which is mounted on the frame 12 by means of bolt 44 (shown in FIG. 3) and is oriented either parallel or perpendicular to the axis of the reflector 10 so that the planar element 41 can rotate about the axis of the bolt 44 and thereby always be oriented vertically. As will be appreciated other angle indicia means including electronic means can be employed for this purpose.

FIG. 6 illustrates an antenna assembly with the angle of elevation and the offset angle which are involved in orienting the antenna shown in a simplified manner.

The following example is given to further illustrate a preferred embodiment of the invention. For mounting the antenna shown in FIG. 2 in Los Angeles, Calif., where the latitude is 34° and the offset angle or angle of declination for that latitude from Table 1 is 5.5°, the angle of elevation at that latitude would be 90°-(34°+5.5°) or 50.5°. Initially, the set screws on the main support pipe or cylinder are loosened and the entire antenna unit is rotated about the axis of the main support to align the polar axis and the receptor axis in a north-south direction. The nut 26 fixing the receptor support frame 12 to the polar axis shaft 23 is loosened and the receptor assembly 13 is tilted in a southwardly direction so that the pointer 42 on the angle indicia 40 indicates an angle 5.5° greater than the angle indicated when the support frame is parallel to the polar axis shaft. The nut 26 is tightened to fix the offset or declination angle therebetween. Then the bolt 35 which passes through slots 34 on the polar axis brackets 30 and 31 is loosened and the entire receptor assembly 13 and the polar axis assembly are vertically rotated so that the angle indicated on the angle indicator 41 is equal to 50.5°, if the angle of elevation is shown, or 39.5° if the sum of the latitude and the offset angle is shown. Bolt 25 is tightened to fix the polar axis at that particular angle with respect to the horizontal. The receptor assembly 13 is then rotated about the polar. axis by hand or by suitable motor means (not shown) until the angle indicia means 40 shows the angle of elevation or its equivalent complimentary angle for a particular satellite, e.g., satellite SATCOM 4, which has an angle of elevation of 36° at Los Angeles, Calif. The set screws 37 and 38 which fix the main support pipe to the mounting post are loosened and the assembly rotated slightly in both directions east and west until the optimum signal is received, i.e., TV reception is best. Then set screws 37 and 38 are tightened and the orientation is complete.

Various modifications and improvements can be made to the invention without departing from the inventive concepts thereof.

I claim:

1. In an antenna adapted to receive signals from an orbiting satellite wherein the antenna has a receptor assembly comprising a parabolic dish-shaped signal reflector fixed to an underlying support frame and a signal receptor at the focal point of the parabolic reflector, said receptor assembly being adjustably mounted on a rotating means adapted to rotate about an axis parallel to the axis of the earth and wherein means are provided for adjusting the angle between the receptor assembly and the rotating means, the improvement comprising an indicator means mounted to the receptor assembly for indicating the angle between the axis of the parabolic dish-shaped signal reflector and the horizontal or the complimentary angle thereof, said indicator means including a substantially planer member inscribed with an angular scale, an angular indicator pivotally connected to said planer member and arranged so as to hang in the vertical plane under the influence of gravity, said planer element being rotatably mounted to the receptor assembly so as to permit said indicator means to continuously realign itself in the vertical plane so as to accurately measure said angle as the receptor assembly rotates about the axis parallel to the axis of the earth.

* * * * *